US006564404B1

(12) United States Patent
Nanahara

(10) Patent No.: US 6,564,404 B1
(45) Date of Patent: May 20, 2003

(54) LIFTABLE SIDE RAIL FOR A LYING TABLE SUCH AS A BED

(75) Inventor: Kenji Nanahara, Funabashi (JP)

(73) Assignee: Paramount Bed Company, Limited, Tokyo (JP)

( * ) Notice: Subject to any disclaimer, the term of this patent is extended or adjusted under 35 U.S.C. 154(b) by 0 days.

(21) Appl. No.: 10/005,126

(22) Filed: Dec. 7, 2001

(51) Int. Cl.[7] ..... A47C 21/08
(52) U.S. Cl. ..... 5/430; 5/428; 5/425
(58) Field of Search ..... 5/424, 425, 428, 5/430, 503.1, 507.1, 658, 662, 100

(56) References Cited

U.S. PATENT DOCUMENTS

| | | | | | |
|---|---|---|---|---|---|
| 1,059,515 | A | * | 4/1913 | Barr | 5/428 |
| 2,676,341 | A | * | 4/1954 | Leone et al. | 5/430 |
| 2,799,869 | A | * | 7/1957 | Leone et al. | 5/430 |
| 2,976,548 | A | * | 3/1961 | Maertins | 5/430 |
| 3,063,066 | A | * | 11/1962 | Peck et al. | 5/429 |
| 6,446,283 | B1 | * | 9/2002 | Heimbrock et al. | 5/425 |

* cited by examiner

*Primary Examiner*—Robert G. Santos
(74) *Attorney, Agent, or Firm*—Townsend & Banta

(57) ABSTRACT

A liftable side rail for a lying table such as a bed, comprising a side rail proper, being pivotally rotatably connected with a pair of support arms pivotally rotatably supported at side rail installation points of the lying table, to be supported in such a manner that the side rail proper may be lifted and lowered by the pivotally rotational motion of these support arms along the pivotally rotational loci between an upper service position and a lower stored position, and each of the support arms, having protrusions functioning as auxiliary side rail members on both sides of the straight line connecting said installation point and the connection point with the side rail proper.

When the side rail is held at the lower stored position, the protrusions provided for the support arms are placed along the side rail proper without protruding above and below. So, the tops and bottoms of the protrusions do not constitute any obstruction. Therefore, even if the lying table is low in the height of the deck, the distance between the bottom of the side rail proper and the floor surface can be kept large.

2 Claims, 8 Drawing Sheets

LIFTABLE SIDE RAIL FOR A LYING TABLE SUCH AS A BED

FIELD OF THE INVENTION

The present invention relates to a side rail disposed above the deck on one lateral side for preventing the bedding such as a bed quilt and a user such as a patient from falling, particularly a liftable side rail, which can be lifted and lowered between the service position above the deck and the stored position below the deck.

BACKGROUND OF THE INVENTION

The conventional side rails to be disposed above the deck on one lateral side of a lying table such as a bed or stretcher include, as described later, a detachable side rail consisting of a side rail proper and columns which are inserted into the fitting holes formed in a lateral side of the deck, for supporting the side rail proper in its service condition, and a liftable side rail in which a side rail proper is supported liftably by any proper lifting mechanism, to be used at a lifted position and to stored at a lowered position for avoiding any disturbance by the top of the side rail proper. They also include an full side rail to cover an entire lateral side of a lying table, and a partial side rail to cover an entire lateral side of a lying table in combination with other side rails, usually another side rail.

As an example of lying tables, medical beds are being specified in dimensions of respective portions by standards to allow their safe use. For example, for partial side rails, for example, IEC specifies the dimensions of respective portions as described below in reference to FIG. 6.

The components of FIG. 6 will be explained at first. Symbol 1 denotes the deck of a bed, and the deck 1 is liftably supported above a base 2 by any proper link mechanism 3, and can be driven to be lifted and lowered by a drive mechanism not illustrated.

Symbol 4 denotes a partial side rail which is supported by any proper support mechanism at one lateral side of the deck 1 in its service condition. Two such partial side rails 4 are installed side by side, to cover the entire lateral side of the deck 1. Each of the partial side rails consists of a side rail proper 5 and columns 6 which are inserted into the fitting holes (not illustrated) formed in a lateral side of the deck 1. As for other illustrated components, symbol 7 denotes a mattress placed on the deck 1; 8, a head board; and 9, a foot board.

The specified dimensions of the respective portions shown in FIG. 6 are described below.

The dimension indicated by A shows the dimension of each closed space formed in the side rail proper 5 of the side rail 4, when the side rail proper 5 is a lattice with spaces in it. The dimension of each space is specified to be 120 mm or less, to prevent that the head of the user enters into the space.

The dimension indicated by D is the dimension of the gap between the side rails proper 5 of the adjacent side rails 4, or the dimension of the gap between the side rail proper 5 on the head board side and the head board 8 or between the side rail proper 5 on the foot board side and the foot board 9. The dimension of any of the gaps is specified to be 60 mm or less to prevent that the neck of the user enters into the gap, or to be 235 mm or more, to prevent that the head is caught in the gap.

The dimension indicated by F is the dimension of the gap between the bottoms of the side rails proper 5 and the deck 1 when there is an open space above the gap. The dimension of the gap is specified to be 120 mm or less to prevent that the head enters into the gap when the neck cannot enter into the above opening, or to be 60 mm or less to prevent that the neck goes into the gap below the side rails proper 5 when the neck can enter into the above opening.

G1 and G2 indicate the horizontal lengths of the side rails proper 5 of the respective side rails 4, and are specified to satisfy a formula of $G1+G2>L/2$, where L is the total length L of the deck 1.

The dimension indicated by H is the height of the side rails proper 5 of the side rails 4 above the mattress, i.e., the dimension between the upper surface of the mattress 8 and the tops of the side rails 4, and is specified to be 220 mm or more.

The dimensions of respective portions of the partial side rails described above are applied also when liftable side rails proper are used at a lifted position.

A conventional example of liftable side rails, particularly partial side rails is described below in reference to FIG. 7.

In FIG. 7, symbol 11 generally denotes a bed equipped with liftable side rails. In this drawing, the detailed structure of the bed is not illustrated, and some components only are indicated by two-dot-dash lines.

Symbol 12 denotes a deck to have a mattress (not illustrated) placed on it, and the deck 12 is divided into four deck portions, i.e., four deck portions 12*a*, 12*b*, 12*c* and 12*d* respectively corresponding to the back, waist, thigh and legs of the user. They are respectively connected to allow pivotal rotation. The deck 12 consisting of these deck portions is supported above a deck support frame 13. For example, the deck portion 12*b* is stationarily supported on the deck support frame 13. The deck portions 12*a* and 12*c* are pivotally rotatably connected with the deck portion 12*b*, and pivotally rotatably and liftably supported respectively by proper drive mechanisms (not illustrated). Said support mechanism and drive mechanisms are not illustrated, since they are well-known.

The deck support frame 13 is supported by any appropriate support mechanism on the floor 15 of a room, etc. The support mechanism is not illustrated. For example, the deck support frame 13 can be supported at a predetermined height by stands with casters or can be liftably supported by a lifting link mechanism above a base as shown in FIG. 6. In FIG. 7, symbol 17 denotes a head board, and 18, a foot board.

On the head board 17 side and the foot board 18 side of the deck support frame 13, pairs of support arms 19*a* and 19*b* are supported pivotally rotatably around the rotary shafts extending in the transverse direction of the bed. At the tips of the pairs of support arms 19*a* and 19*b*, side rails proper 20*a* and 20*b* are pivotally rotatably connected, to form parallel motion link mechanisms. The support arms 19*a* and 19*b* can also be pivotally rotatably supported on the deck portions 12*a*, 12*c*, etc., not on the deck support frame 13.

In the above constitution, the side rails proper 20*a* and 20*b* are lifted and lowered by the pivotally rotational motion of the support arms 19*a* and 19*b* in parallel along the pivotally rotational loci. The condition that they are held at a lowered position is the stored condition, and the condition that they are held at a lifted position indicated by one-dot-dash lines is the service condition. FIG. 7 shows the side rail proper 20*a* on the head board 17 side in its service condition, and the side rail proper 20*b* on the foot board 18 side in its stored condition. The holding mechanism for the service condition and the stored condition is not illustrated, and any proper mechanism using, for example, stopper pins as described later can be used.

These side rails proper 20*a* and 20*b* are constituted to satisfy the above mentioned standard dimensions in their service condition. For example, the dimension indicated by b in the drawing corresponds to the dimension of A in the above mentioned standard. According to the standard, b must be 120 mm or less, to prevent that the head of the user does not enter into the gap.

As described above, the liftable side rails, the side rails proper 20*a* and 20*b* of which are liftably supported by a lifting mechanism in the service condition at the lifted service position and also in the stored condition at the lowered stored position, must conform to the standard dimensions as described above in the service condition. However, also in the stored condition, there are desirable dimensions in view of convenience.

That is, in the use of the bed shown in FIG. 7, when the side rails proper 20*a* and 20*b* are held at the stored position, it can happen that an attendant nurses the user such as a patient lying on the bed, or that the table plate of a movable bed side table is moved and located above the bed. In the former case, it can happen that the attendant inserts his/her legs into the gap formed between the bottoms of the side rails proper 20*a* and 20*b* in the stored condition and the floor surface 15 of the sickroom, etc., and in the latter case, the base of the bed side table is moved inside the gap. So, it is desirable that the gap d is larger.

On the other hand, recently there is a tendency to keep the height of the bed deck 12 low, because of various advantages that the user such as a patient can easily get on and off the bed deck 12 and sit at the edge of the deck 12 and that the attendant can more easily nurse if the bed is low in deck height.

In the liftable side rails, the side rails proper 20*a* and 20*b* of which can be lifted and lowered in parallel by the pivotal rotation of the support arms 19*a* and 19*b*, it is a contradictory challenge to keep the height of the bed deck 12 low, while keeping the distance d between the bottoms of the side rails proper 20*a* and 20*b* and the floor surface 15 large.

For example, FIG. 8 shows an attempt to keep the distance d between the bottoms of the side rails proper 20*a* and 20*b* and the floor surface 15 large in the bed of FIG. 7.

In the bed of FIG. 8, the vertical height c of the side rails proper 20*a* and 20*b* is shorter than that of the side rails proper 20*a* and 20*b* of FIG. 7, to keep the distance d between the bottoms of the side rails proper 20*a* and 20*b* and the floor surface 15 large, while keeping the distance e between the floor surface 15 and the deck 12 and the distance a between the deck 12 and the tops of the side rails proper 20*a* and 20*b*, i.e., the height of the side rails proper 20*a* and 20*b* above the deck equal to those of the bed of FIG. 7.

If the vertical height c of the side rails proper 20*a* and 20*b* are kept smaller like this, the distance d between the bottoms of the side rails proper 20*a* and 20*b* and the floor surface 15 can be kept larger by that. However, in this case, the dimension indicated by b in the drawing becomes large, and there arises a possibility that the dimension indicated by A in the above mentioned standard may not be satisfied.

So, hitherto, these dimensions are set considering the above mentioned contradictory challenge, and it is very difficult to keep the distance d between the bottoms of the side rails proper 20*a* and 20*b* and the floor surface 15 large while satisfying the respective standard values of the side rails proper.

SUMMARY OF THE INVENTION

This invention has been conceived in view of the above. The object of this invention is to provide a liftable side rail, the side rail proper of which can be lifted and lowered by the pivotal rotation of support arms along the pivotally rotational loci, characterized by allowing the standard values of respective dimensions of the side rail proper to be satisfied, while allowing the bed deck height low and allowing the distance between the bottom of the side rail proper and the floor surface to be kept large at the stored position.

This object can be achieved by a liftable side rail for a lying table such as a bed, comprising a side rail proper, being pivotally rotatably connected with a pair of support arms pivotally rotatably supported at side rail installation points of the lying table such as a bed, to be supported in such a manner that the side rail proper may be lifted and lowered by the pivotally rotational motion of these support arms along the pivotally rotational loci between an upper service position and a lower stored position, and each of the support arms, having protrusions functioning as auxiliary side rail members on both sides of the straight line connecting said installation point and the connection point with the side rail proper.

In the liftable side rail of this invention, each of the support arms can have a parallelogrammic frame provided on the upper side, and the ends of the shorter diagonal of the frame can correspond to the connection point with the side rail proper and the installation point, while the ends of the longer diagonal of the frame can define the protrusions.

Furthermore, in the liftable side rail of this invention, each of the support arms can be a plate with a parallelogrammic portion on the upper side, and the ends of the shorter diagonal of the plate can correspond to the connection point with the side rail proper and the installation point, while the ends of the longer diagonal of the plate can define the protrusions.

Moreover, in the liftable side rail of this invention, each of the support arms can have frame halves on both side of a straight arm portion.

In these constitution, when the side rail is held at the lower stored position, the protrusions provided for the support arms are placed along the side rail proper without protruding above and below. So, the tops and bottoms of the protrusions do not constitute any obstruction. Therefore, even if the lying table is low in the height of the deck, the distance between the bottom of the side rail proper and the floor surface can be kept large.

DETAILED DESCRIPTION OF THE PREFERRED EMBODIMENTS

Preferred embodiments of this invention are described below in more detail in reference to attached drawings.

Figure 1:
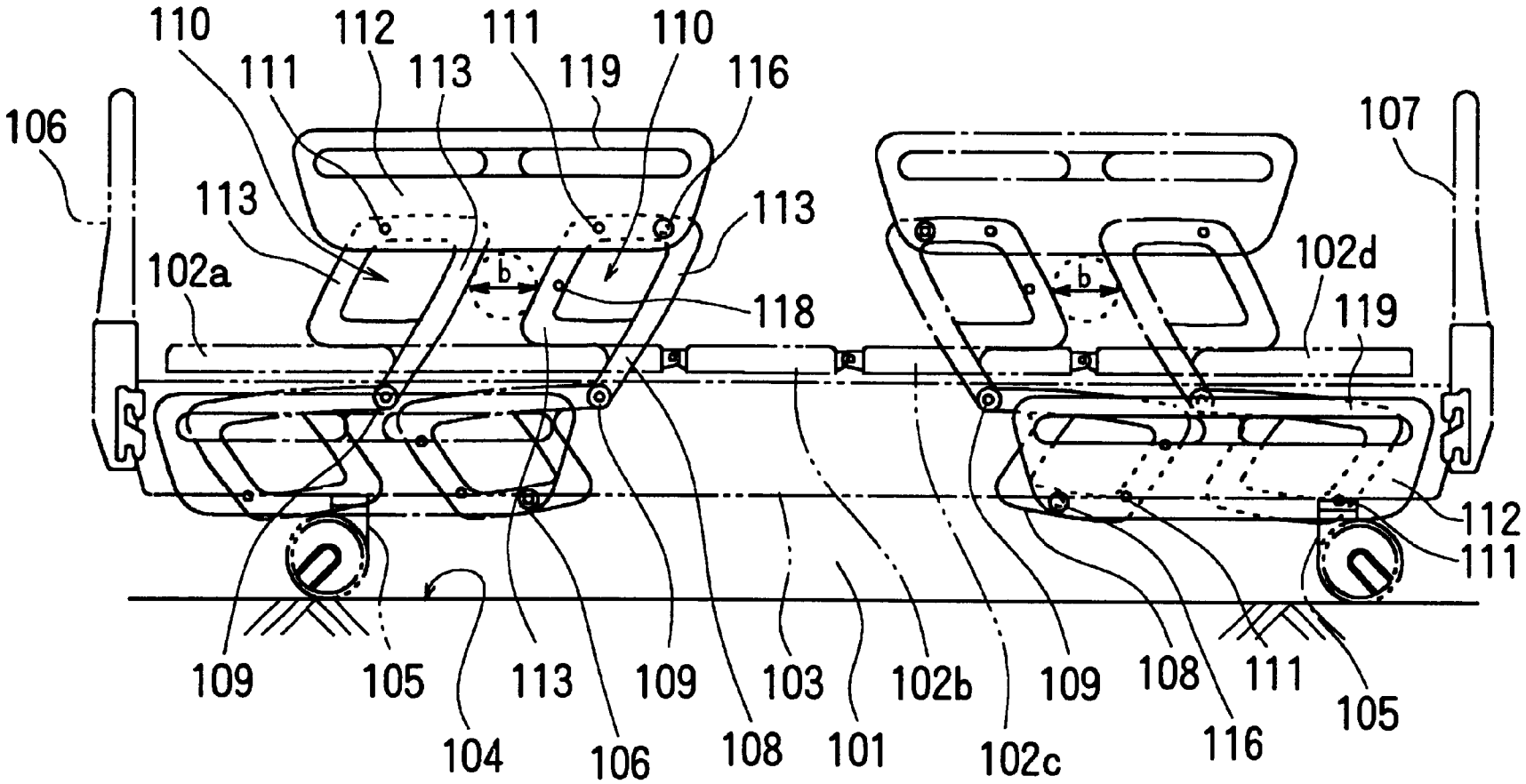
FIG. 1 is a side view showing a preferred embodiment, in which the liftable side rail of this invention is applied to a lying table, particularly a bed.
Figure 7:
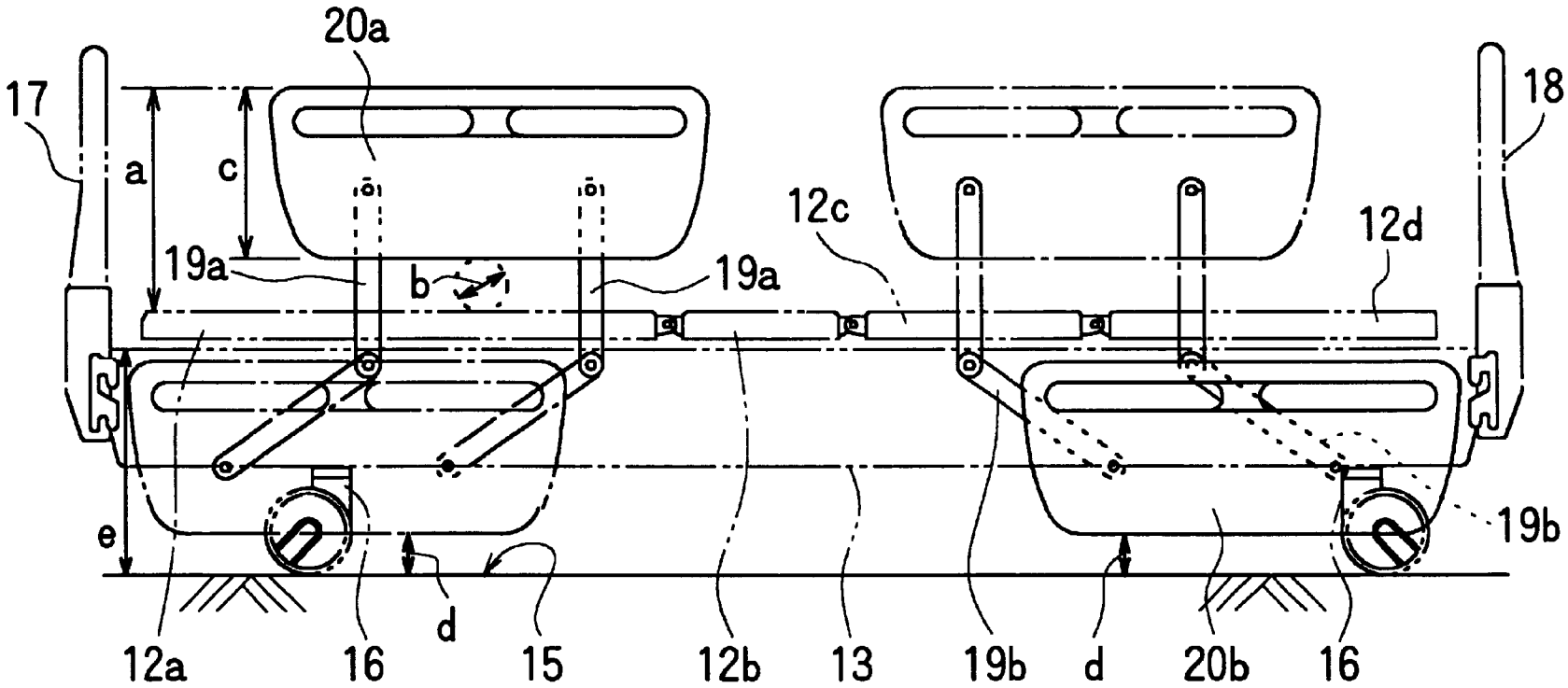
FIG. 7 PRIOR ART
FIG. 7 is a side view for showing a bed, to which conventional partial side rails are applied.
Figure 8:
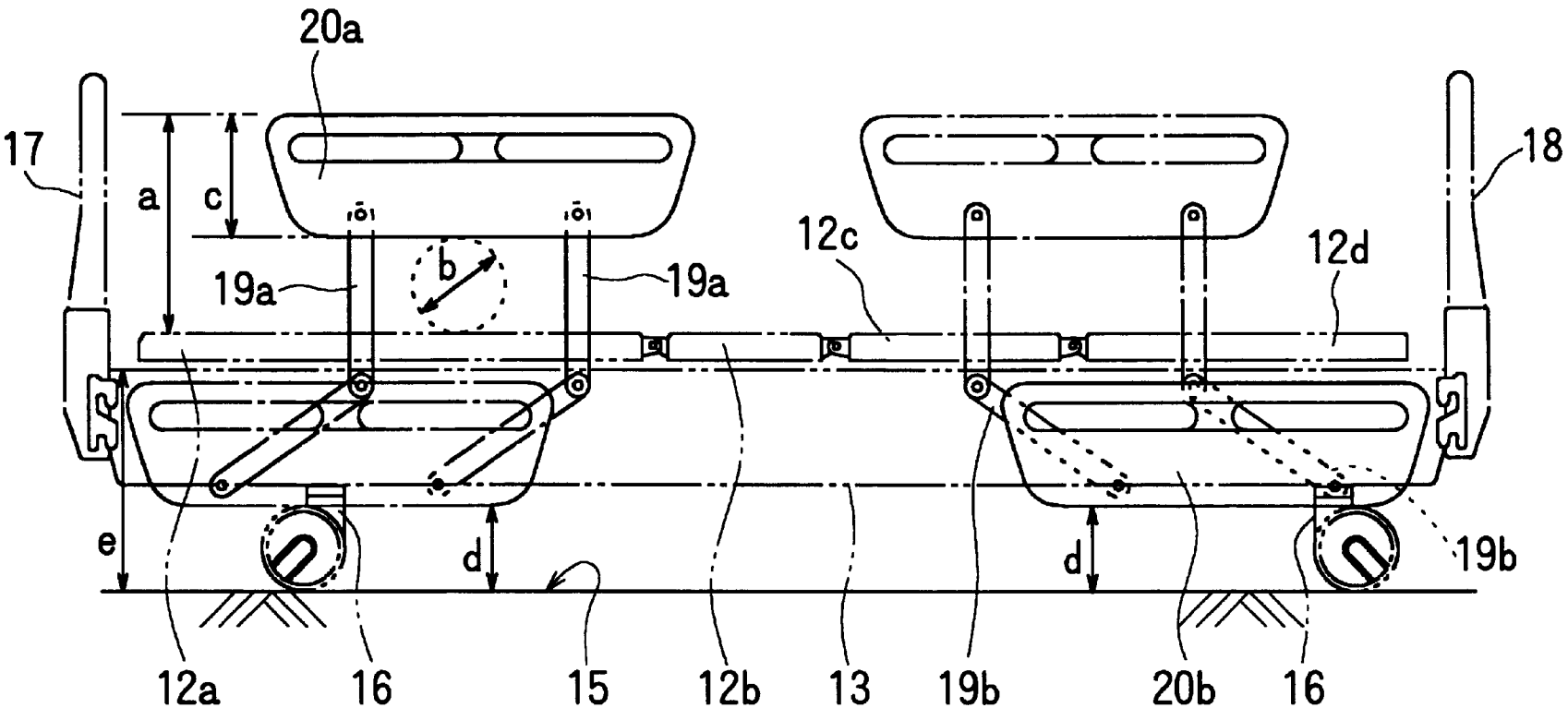
FIG. 8 PRIOR ART
FIG. 8 shows a modified bed of FIG. 7, in which the vertical height of the side rails proper is kept smaller to keep the distance between the bottoms of the side rails proper and the floor surface larger.

FIG. 1 shows a first preferred embodiment, in which the liftable side rail of this invention is applied. In the drawing, symbol 101 generally denotes a bed. In this drawing, the detailed structure of the bed is not illustrated as in FIGS. 7 and 8 showing conventional examples, and some components only are indicated by two-dot-dash lines.

Symbol 102 generally denotes a deck to have a mattress (not illustrated) placed on it, and the deck 102 is divided into four deck portions, i.e., four deck portions 102*a*, 102*b*, 102*c* and 102*d* respectively corresponding to the back, waist, thigh and legs of the user. They are respectively connected to allow pivotal rotation. The deck 102 consisting of these deck portions is supported above a deck support frame 103. For example, the deck portion 102*b* is stationarily supported on the deck support frame 13. The deck portions 102*a* and 102*c* are pivotally rotatably connected with the deck portion 102*b* as described above, and pivotally rotatably and liftably supported respectively by drive mechanisms (not illustrated). The support mechanism and drive mechanisms for them are not illustrated, since they are well-known as described above.

Figure 6:
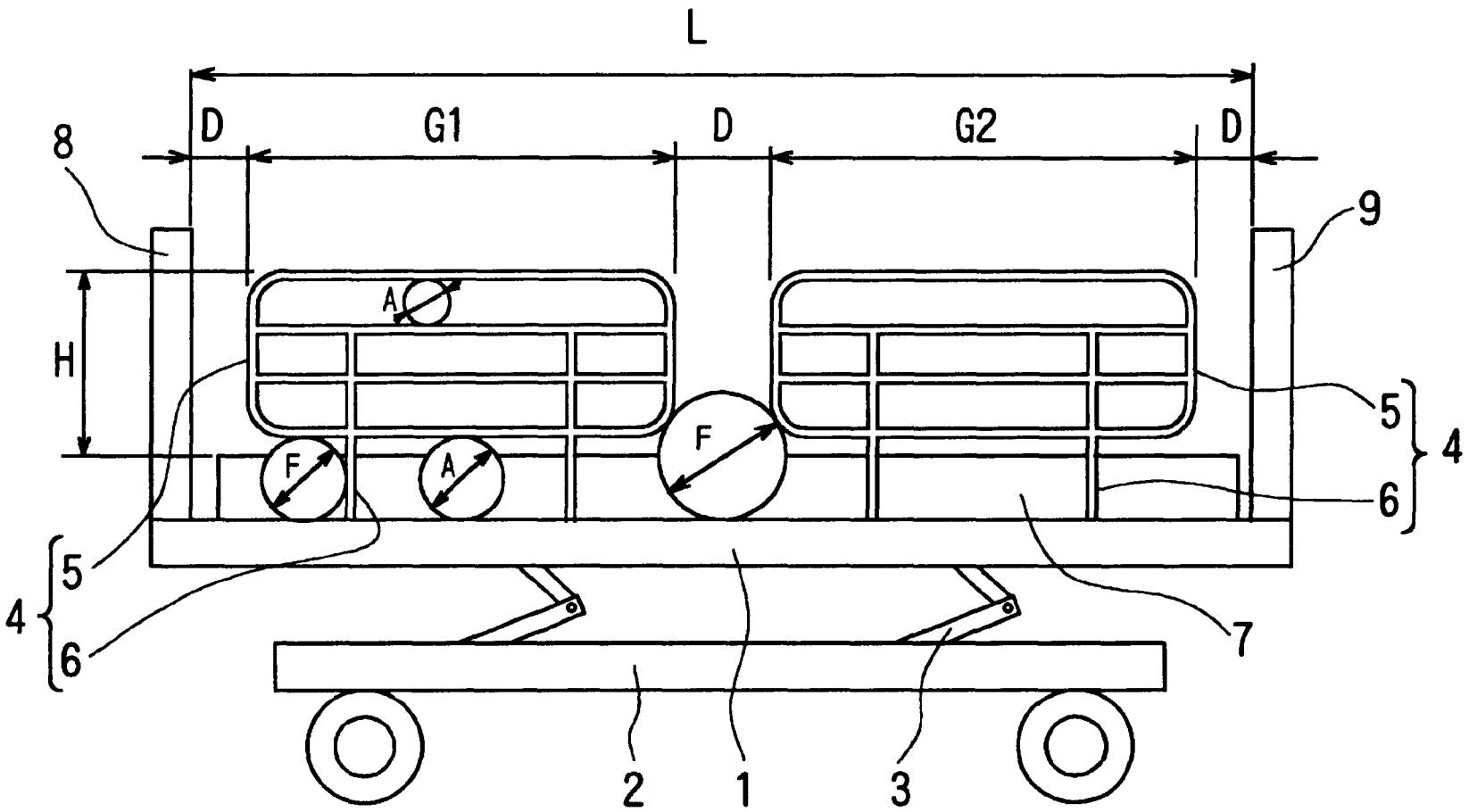
FIG. 6 PRIOR ART
FIG. 6 is a side for illustrating an standard for dimensions of respective portions of partial side rails in a bed.

The deck support frame 103 is supported by any appropriate support mechanism on the floor 104 of a room, etc. The support mechanism is not illustrated. For example, the deck support frame 103 can be supported at a predetermined height by stands with casters or can be liftably supported by a lifting link mechanism above a base as shown in FIG. 6. In FIG. 1, symbol 106 denotes a head board, and 107, a foot board.

On the head board 106 side and the foot board 107 side of the deck support frame 103, respectively one pair of support arms 108 are supported pivotally rotatably around the rotary shafts extending in the transverse direction of the bed 101. The pivotally rotational fulcrums of these support arms 108 are indicated by 109 in the drawing. In the following description, pairs of components are indicated by the same symbols like this respectively for the sake of convenience.

Each of the support arms 108 has a parallelogrammic frame 110 provided on the upper side, and at the upper end 111 of the shorter diagonal of the frame 110, the support arm 108 is pivotally rotatably connected with the side rail proper 112. Furthermore, with the tip of the portion protruding downward from the short diagonal of the frame 110 as said pivotally rotational fulcrum 109, the support arm 108 is pivotally rotatably connected with the deck support frame 103.

In the above constitution, on both sides of the straight line (line L in FIG. 2) connecting the connection point 111 of the support arm 108 and the pivotally rotational fulcrum 109, the ends of the longer diagonal of the frame 110 are protruded to define protrusions 113 as components of the frame 110 at both sides of the support arm 108.

In the above constitution, the side rail proper 112 is moved in parallel along the pivotally rotational loci of both the right and left support arms 108 by the pivotal rotation of the support arms 108 around the pivotal rotational fulcrums 109, into the upper service position or the lower stored position, and is held at the respective positions by a holding mechanism as described later in the service condition or the stored position.

In this case, the support arms 108 on the head board 106 side are designed to be pivotally rotated clockwise for ascending and to be pivotally rotated counterclockwise for descending. On the other hand, the support arms 108 on the foot board 107 side are designed, on the contrary, to be pivotally rotated clockwise for descending and to be pivotally rotated counterclockwise for ascending. Therefore, both the side rails proper 112 on the head board 106 side and the foot board 107 side are kept standing by near the ends of the deck support frame 103, and a wide space can be secured between them.

In FIG. 1, on the head board 106 side, the components of the side rail held in the service condition at the service position are drawn by solid lines, and the components of the side rail held in the stored condition at the stored position are drawn by one-dot-dash lines. On the foot board 107 side, on the contrary, the components of the side rail held in the service condition at the service position are drawn by one-dot-dash lines, and the components of the side rail held in the stored condition at the stored position are drawn by solid lines.

Figure 2:
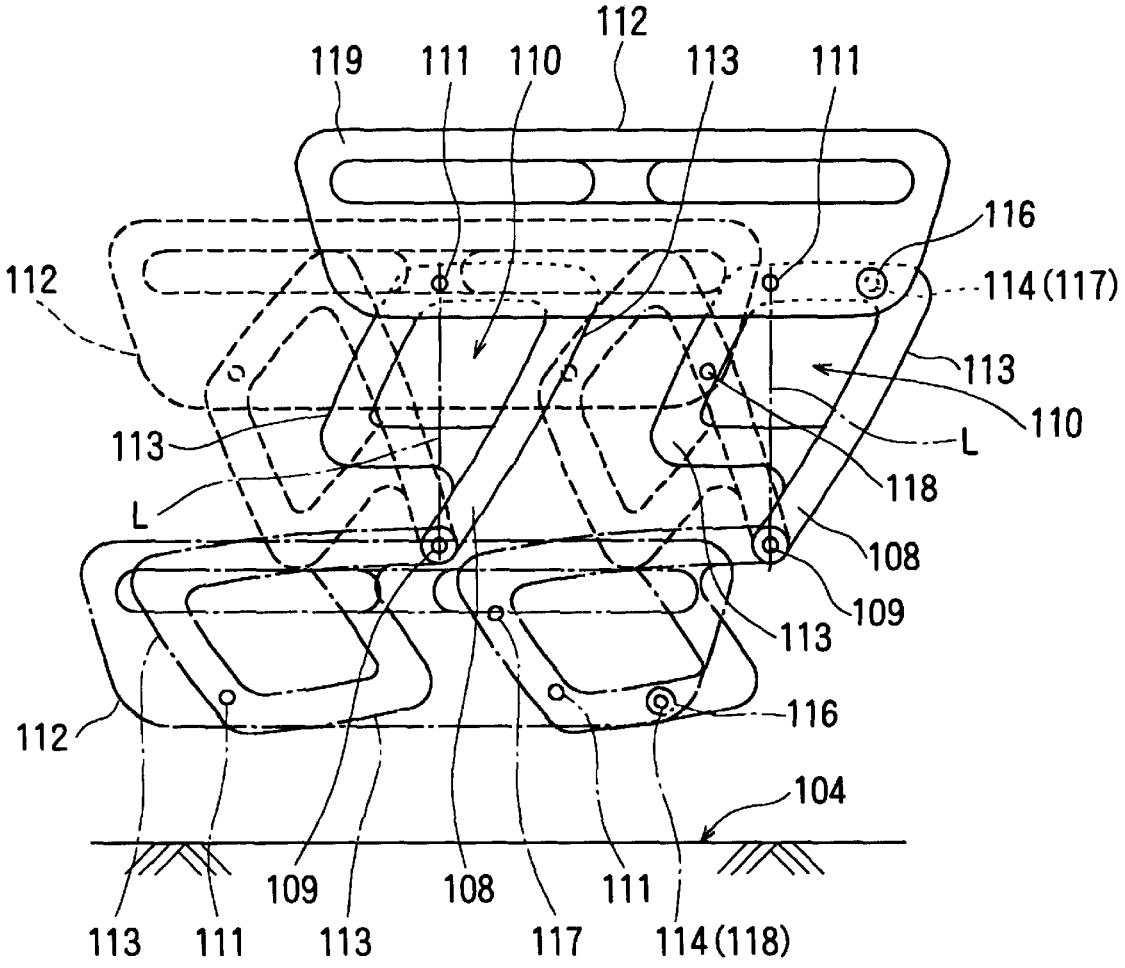
FIG. 2 is an expanded illustration for illustrating the action of an important portion of FIG. 1.

As shown in FIG. 1 and FIG. 2 as a partial expanded view of FIG. 1, in this preferred embodiment, the protrusions 113 defined by the ends of the long diagonal of the parallelogrammic frame 110 constituting each of the support arms 108 are formed on both sides of the straight line (L) connecting the connection point 111 and the pivotally rotational fulcrum 109, and functions as auxiliary side rail members. So, even if the side rail proper 112 is kept smaller in vertical height, the closed space formed below the bottom of the side rail proper 112, particularly the dimension of the closed space formed between the right and left support arms 108 can be kept smaller by the protrusions 113, and the dimensional requirement of the side rail proper 112 can be satisfied.

The protrusion 113 on the front side of the support arm 108 on the front side so called in the direction in which the side rail proper 112 on the head board 106 side is pivotally rotated to descend can be kept smaller in the protruding dimension, since it does not have the function to narrow the closed space, unlike the protrusion 113 on the rear side which functions to narrow the closed space in combination with the adjacent protrusion 113 on the front side of the support arm 108 on the rear side.

That is, the two support arms 108 connected with the side rail proper 112 are not necessarily required to be identical in form.

On the other hand, as can be seen from the drawing, when the side rail 112 is held at the lower stored position, the protrusions 113 provided for the support arms 108 are placed along the side rail proper 113 without protruding above an and below. So, the tops and bottoms of the protrusions 113 do not constitute any obstruction. Therefore, even if the lying table such as a bed is low in the height of the deck 102, the distance between the bottom of the side rail proper 112 and the floor surface 104 can be kept large.

Figure 3:
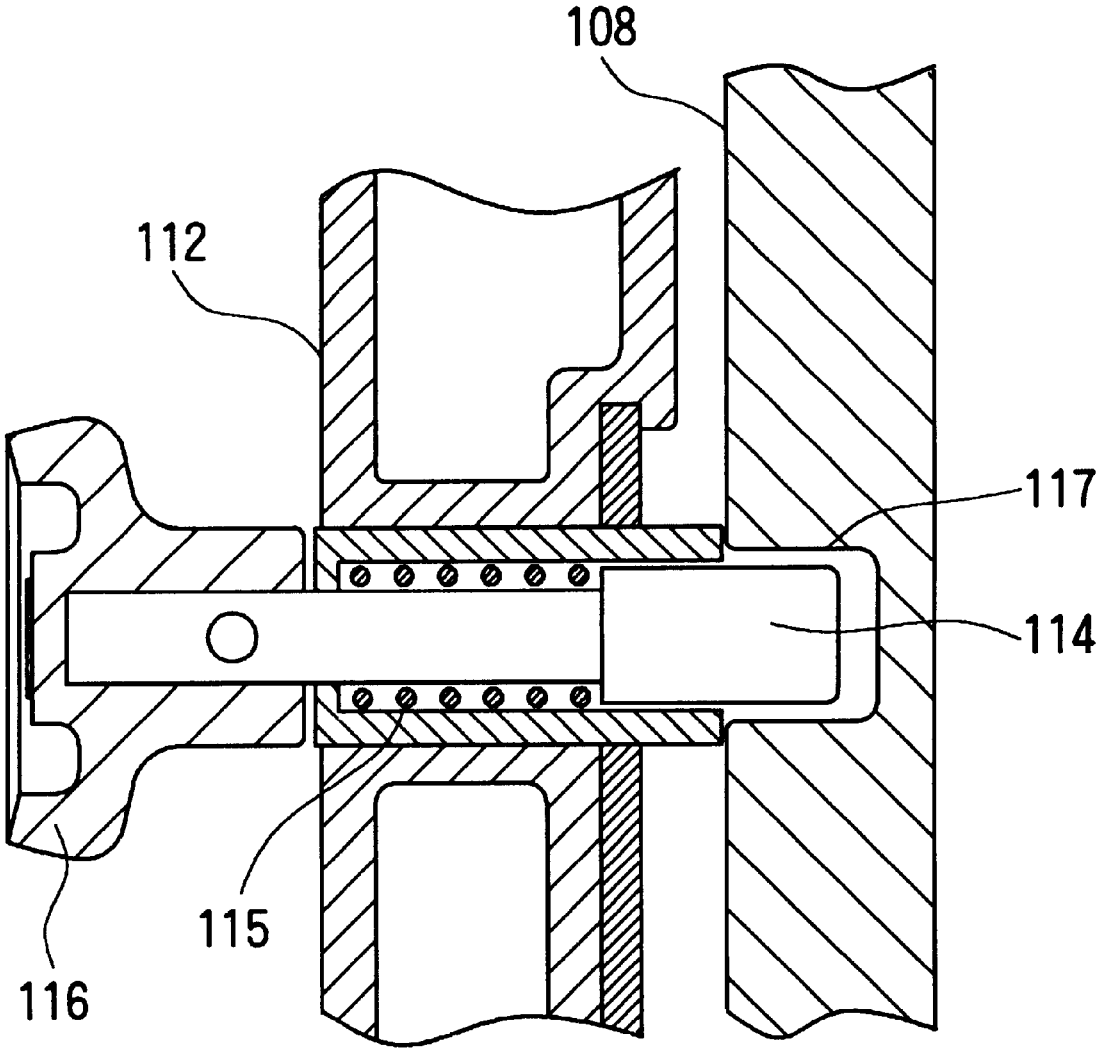
FIG. 3 is a sectional view showing a preferred embodiment of a stopper mechanism for holding the side rail proper at the service position and the stored position.

A preferred embodiment of the mechanism for holding the side rail proper at the stored position and the service position is described below in reference to FIG. 1 and also to FIGS. 2 and 3. FIG. 2 is an expanded illustration of the side rail on the head board 106 side of FIG. 1, and FIG. 3 is a partial sectional view showing the holding mechanism of FIG. 2. The components corresponding to those of FIG. 1 are indicated by the same symbols, to avoid double explanation.

In FIG. 3, symbol 114 denotes a stopper pin set in the side rail 112, protrudably toward the support arm 108, and the stopper pin 114 can be protruded toward the support arm 108 by the resilience of a compression coil spring 115 and can be retracted by pulling a control knob 116. A fitting hole 117 into which the stopper pin 114 can be protruded is formed in the support arm 108.

In reference to FIG. 2, a fitting hole into which the stopper pin 114 can be fitted is formed not only in the above position, but also in the position indicated by symbol 118 in FIG. 2, of the support arm 108, though not illustrated in FIG. 3. The fitting holes 117 and 118 are located on the same circle around the connection point 111.

In the solid line condition of FIG. 2, the stopper pins 114 are fitted in the fitting holes 117 of the upper arms 108, and because of it, the support arms 108 cannot be pivotally rotated around the connection points 111 relatively to the side rail proper 112.

For this reason, the side rail proper 112 and the pair of right and left support arms 108 which are components of a four-node link mechanism are held in the solid line condition of FIG. 2, and this position is the service position of the side rail proper 112.

To relocate the side rail proper 112 from the service condition to the stored condition, at first, the control knobs 116 are pulled, to retract the stopper pins 114 from the fitting holes 117. As a result, the support arms 108 as components of the four-node link mechanism can be pivotally rotated around the connection points 111 relatively to the side rail proper 112. So, the support arms 108 can be pivotally rotated, for example, by manually manipulating the handling portion 119 provided at the top of the side rail proper 112, to allow the side rail proper 112 to descend along the pivotally rotational loci.

When the side rail proper 112 reaches the lower predetermined position, the stopper pins 114 correspond to the other fitting holes 118 formed in the support arms 108, and are protruded into the fitting holes 118 by the resilience of the compression coil springs 115, and in the same condition as described above, the support arms 108 cannot be pivotally rotated relatively to the side rail proper 112. So, the side rail proper 112 is held at the lowered position, and the position is the stored position of the side rail proper 112.

The side rail proper 112 can be relocated from the stored position to the service position by taking an action reverse to the above.

Figure 4:
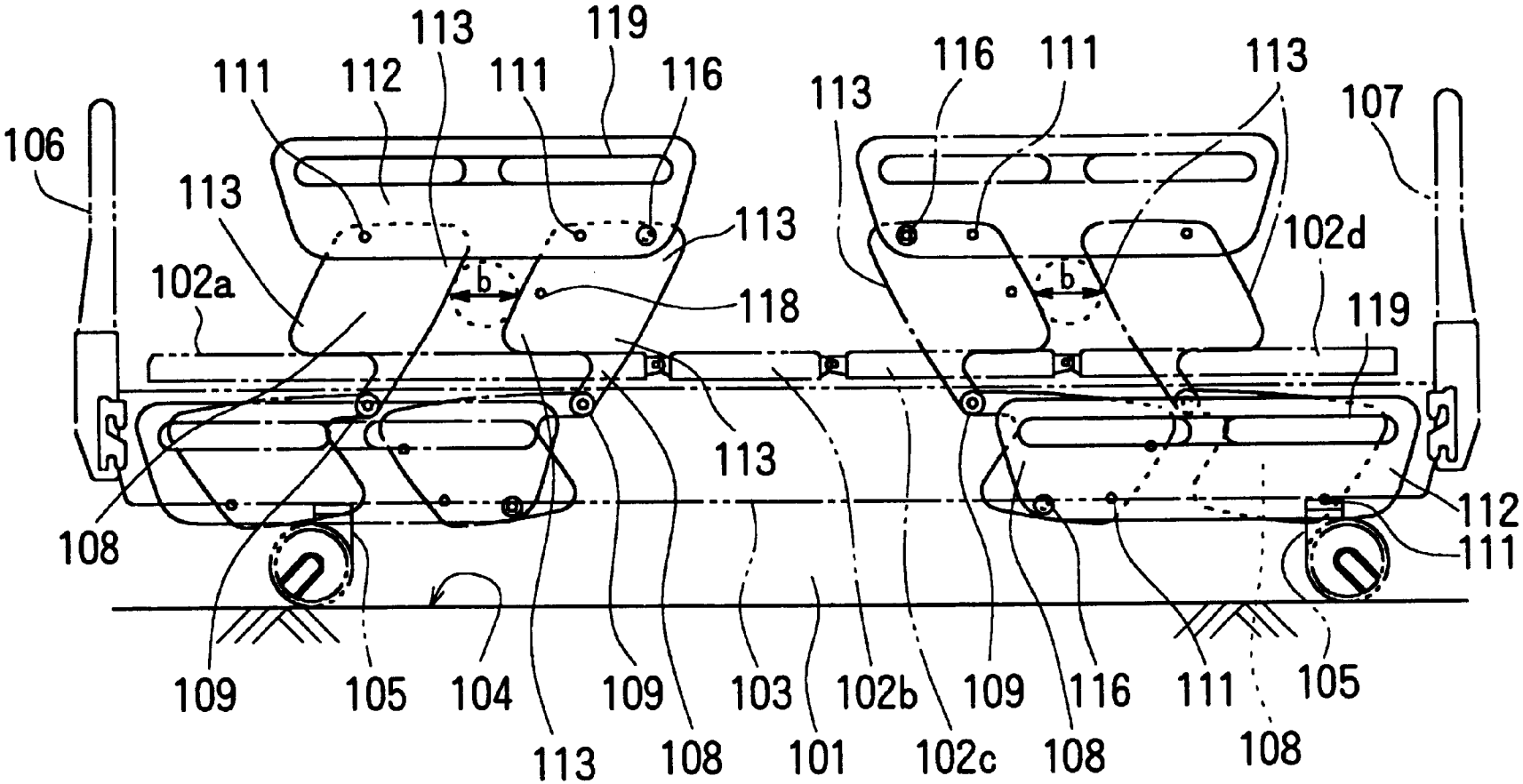
FIG. 4 is a side view showing another preferred embodiment, in which the liftable side rail of this invention is applied to a bed.

FIG. 4 shows a second preferred embodiment, in which the liftable side rail of this invention is applied to a bed. This second preferred embodiment is generally different from the first preferred embodiment only in the constitution of the support arms 108, and remains identical in the other basic constitution. So, in FIG. 4 showing the second preferred embodiment, the same components as those of the first preferred embodiment are indicated by the same symbols, to avoid double explanation.

In the first preferred embodiment, the protrusions 113 of the support arms 108 are formed by parallelogrammic frames 110. However, in the second preferred embodiment, each of the support arms 108 is formed by a plate with a parallelogrammic portion formed on the upper side, and the shorter diagonal of the plate corresponds to the connection point 111 with the side rail proper 112 and the pivotally rotational fulcrum 109 of the installation point, while the ends of the longer diagonal of the plate define the protrusions 113 on both sides of the shorter diagonal line. The support arms 108 of this constitution can be easily manufactured.

The ascending and descending actions of the support arms 108 and the side rails proper 112 in this constitution are not described here, since they are obvious from the detailed description of the first preferred embodiment and the depiction in FIG. 4.

Figure 5:
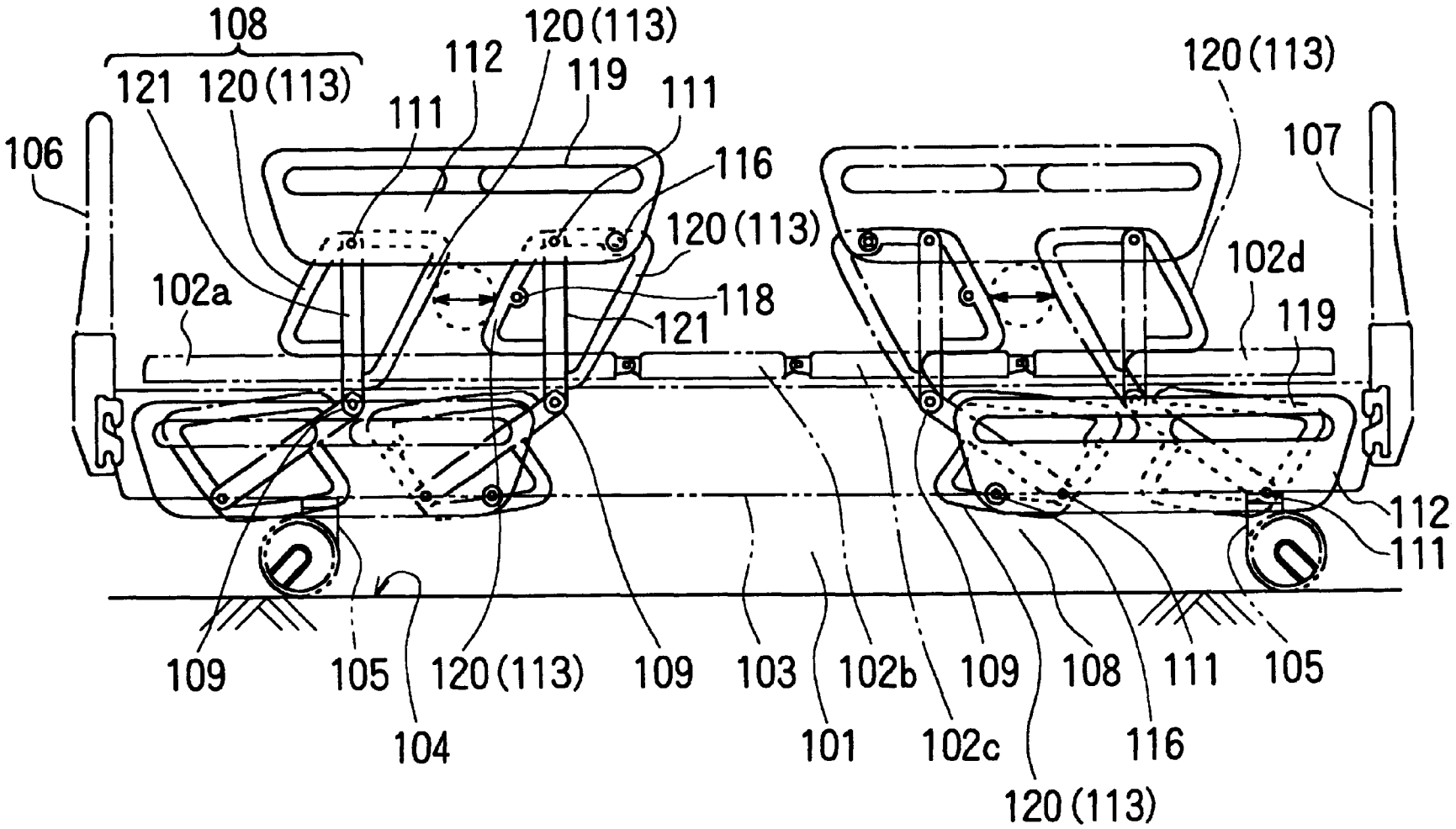
FIG. 5 is a side view showing a further other preferred embodiment, in which the liftable side rail of this invention is applied to a bed.

FIG. 5 shows a third preferred embodiment, in which the liftable side rail proper is applied to a bed. This third preferred embodiment is generally different from the first preferred embodiment in the constitution of support arms 108 only, and remains identical in the other basic constitution, like the second preferred embodiment. So, also in FIG. 5 showing the third preferred embodiment, the same components as those of the first preferred embodiment are indicated by the same symbols, to avoid double explanation.

In each of the support arms 108 in the first preferred embodiment, the protrusions 113 are formed by a parallelogrammic frame 110. However, in the third preferred embodiment, each of the support arms 108 has the halves of a frame 120 on both sides of a straight arm portion 121, to let the frame 120 function as the protrusions 113.

In this constitution, the function of the arm portions 121 to receive the load of the side rail proper 112 and the function of the protrusions 113 as auxiliary side rail members can be differently manifested by using respectively suitable members.

INDUSTRIAL APPLICABILITY

The present invention relates to a side rail disposed above the deck on one lateral side for preventing the bedding such as a bed quilt and a user such as a patient from falling, particularly a liftable side rail, the side rail proper of which can be lifted and lowered between the service position above the deck and the stored position below the deck. This side rail has the following advantages.

a. In a liftable side rail, the side rail proper of which is moved in parallel to ascend and descend by the pivotal rotation of support arms, the contradictory challenge of keeping the bed deck height low and keeping the distance between the bottom edge of the side rail proper and the floor surface at the stored position large can be solved, and even a bed with a low deck height can have a side rail proper with a sufficient height and allows the distance between the bottom edge of the side rail proper and the floor surface to be kept large.

b. Since it is required only to change the constitution of the support arms, a liftable side rail with required functions can be obtained very simply at low cost.

What is claimed is:

1. A liftable side rail for a lying table such as a bed, comprising a side rail proper, being pivotally rotatably connected with a pair of support arms pivotally rotatably supported at side rail installation points of the lying table such as a bed, to be supported in such a manner that the side rail proper may be lifted and lowered by the pivotally rotational motion of these support arms along the pivotally rotational loci between an upper service position and a lower stored position, and each of the support arms, having protrusions functioning as auxiliary side rail members on both sides of the straight line connecting said installation point and the connection point with the side rail proper;

wherein each of the support arms has a parallelogrammic frame provided on the upper side, and the ends of the shorter diagonal of the frame correspond to the connection point with the side rail proper and the installation point, while the ends of the longer diagonal of the frame define the protrusions.

2. A liftable side rail for a lying table such as a bed, comprising a side rail proper, being pivotally rotatably connected with a pair of support arms pivotally rotatably supported at side rail installation points of the lying table such as a bed, to be supported in such a manner that the side rail proper may be lifted and lowered by the pivotally rotational motion of these support arms along the pivotally rotational loci between an upper service position and a lower stored position, and each of the support arms, having protrusions functioning as auxiliary side rail members on both sides of the straight line connecting said installation point and the connection point with the side rail proper;

wherein each of the support arms is a plate with a parallelogrammic portion on the upper side, and the ends of the shorter diagonal of the plate correspond to the connection point with the side rail proper and the installation point, while the ends of the longer diagonal of the plate define the protrusions.

* * * * *